US010933287B1

(12) United States Patent
Brekke et al.

(10) Patent No.: US 10,933,287 B1
(45) Date of Patent: Mar. 2, 2021

(54) GOLF CLUB HEAD

(71) Applicant: SUMITOMO RUBBER INDUSTRIES, LTD., Kobe (JP)

(72) Inventors: Dustin Brekke, Fountain Valley, CA (US); Anthony Munson, Huntington Beach, CA (US); Farbod Gharaei, Irvine, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 16/703,956

(22) Filed: Dec. 5, 2019

Related U.S. Application Data

(60) Provisional application No. 62/873,630, filed on Jul. 12, 2019.

(51) Int. Cl.
*A63B 53/04* (2015.01)
*A63B 53/00* (2015.01)

(52) U.S. Cl.
CPC ..... *A63B 53/047* (2013.01); *A63B 53/005* (2020.08); *A63B 53/045* (2020.08); *A63B 53/0433* (2020.08); *A63B 53/0466* (2013.01); *A63B 2053/0479* (2013.01)

(58) Field of Classification Search
CPC . A63B 53/047; A63B 53/0466; A63B 53/005; A63B 53/0433; A63B 53/045; A63B 2053/0479
See application file for complete search history.

(56) References Cited

U.S. PATENT DOCUMENTS 1,257,471 A * 2/1918 Fitzjohn ..... A63B 60/00 473/330
4,840,380 A * 6/1989 Kajita ..... A63B 60/46 473/291
6,290,607 B1 9/2001 Gilbert et al.
6,602,147 B2 * 8/2003 Shiraishi ..... A63B 53/00 473/291
6,780,123 B2 8/2004 Hasebe
6,830,519 B2 * 12/2004 Reed ..... A63B 53/047 473/290
7,137,903 B2 * 11/2006 Best ..... A63B 53/047 473/290

(Continued)

FOREIGN PATENT DOCUMENTS

JP 2001198243 A * 7/2001
JP 2003320061 A * 11/2003 ..... A63B 53/0466

*Primary Examiner* — Stephen L Blau
(74) *Attorney, Agent, or Firm* — Oliff PLC

(57) ABSTRACT

An iron-type golf club head includes a heel, a toe, a top portion, a sole portion, a top portion, a rear portion, and a striking wall. The striking wall includes a striking face having a plurality of scorelines and a face center and a rear surface. A minimum striking wall thickness Tmin is no greater than 2.5 min. A thickened central region of the striking wall has a maximum thickness, Tmax, greater than Tmin but no greater than 2.75. A first thickness T1 of the striking wall corresponds with a first location spaced toe-ward from the face center by a first distance D1 of between 20 mm and 30 mm. A second thickness T2 of the striking wall. corresponds with a second location spaced heel-ward from the face center by the first distance D1 such that T1 is greater than T2 by no less than 0.05 mm.

6 Claims, 20 Drawing Sheets

(56) References Cited

U.S. PATENT DOCUMENTS

| | | | | |
|---|---|---|---|---|
| 7,553,241 | B2 * | 6/2009 | Park | A63B 53/047 473/290 |
| 7,614,964 | B2 | 11/2009 | Matsunaga | |
| 7,651,414 | B2 * | 1/2010 | Rae | A63B 53/0466 473/346 |
| 7,938,736 | B2 * | 5/2011 | Park | A63B 53/047 473/290 |
| 8,187,118 | B2 | 5/2012 | Matsunaga et al. | |
| 8,206,242 | B2 * | 6/2012 | Jertson | A63B 53/0466 473/332 |
| 8,272,974 | B2 * | 9/2012 | Mickelson | A63B 53/047 473/314 |
| 8,435,132 | B2 | 5/2013 | Oldknow et al. | |
| 8,727,909 | B2 * | 5/2014 | Guerrette | A63B 53/047 473/345 |
| 9,387,374 | B2 | 7/2016 | Golden et al. | |
| 9,750,993 | B2 | 9/2017 | Ritchie et al. | |
| 9,814,950 | B2 * | 11/2017 | Lytle | A63B 53/047 |
| 9,981,168 | B2 * | 5/2018 | Ines | B21K 17/00 |
| 10,065,087 | B2 * | 9/2018 | Sander | A63B 53/0466 |
| 10,155,145 | B2 * | 12/2018 | Girard | A63B 53/047 |
| 10,173,106 | B2 | 1/2019 | Slaughter et al. | |
| 2003/0181259 | A1 * | 9/2003 | Shimazaki | A63B 53/047 473/350 |
| 2013/0252754 | A1 * | 9/2013 | Bazzel | A63B 53/047 473/290 |
| 2018/0345091 | A1 * | 12/2018 | Sander | A63B 53/0466 |

* cited by examiner

200

GOLF CLUB HEAD

BACKGROUND

Golf club equipment design is an area in which balance must be struck between the traditional appearance and performance level of equipment, yet satisfy the steady demand of golfers for innovations which increase the enjoyment and excitement of the sport. Along these lines, where shot distance is often limited by rules promulgated by organizations sanctioning acceptable equipment use in tournament play, attention is often turned to other areas in which golf equipment may be made more suitable for golfers. One such area is increasing the overall forgiveness of golf clubs, thus increasing enjoyment of the game particularly for golfers with higher handicaps. Another area, particularly in the case of iron-type golf club heads or club heads lofted in the range of 20 to 50 degrees, is consistency in feel and distance gapping.

SUMMARY

A need exists for an iron-type or hybrid-type golf club head, or mixed set thereof, that judiciously provides competitive performance values so that structural integrity is ensured and abundant discretionary weight is freed for providing consistency in feel and distance gapping.

An iron-type golf club head according to an example of the disclosure may include a heel, a toe, a top portion, a sole portion, a rear portion, and a striking wall. The striking wall includes a striking face, having a plurality of scorelines and a face center, and a rear surface. A minimum striking wall thickness Tmin is no greater than 2.5 min. A thickened central region of the striking wall has a maximum thickness, Tmax, greater than Tmin but no greater than 2.75. A first thickness T1 of the striking wall corresponds with a first location spaced toe-ward from the face center by a first distance D1 of between 20 mm and 30 mm. A second thickness T2 of the striking wall corresponds with a second location spaced heel-ward from the face center by the first distance D1 such that T1 is greater than T2 by no less than 0.05 mm.

In another example of the present disclosure, a set of golf club heads may include a first golf club head and a second golf club head. The first golf club head comprises a hollow-type golf club head and has a first loft between 18° and 28°. The second golf club head comprises a cavity-back golf club head and has a second loft between 34° and 50°, Each golf club head of the set comprises a center of gravity and a moment of inertia, Izz, about a virtual vertical axis passing through the center of gravity. The standard deviation of all the moments of inertia of the golf club heads is no greater than 100 $g*cm^2$.

In another example of the present disclosure, a set of golf club heads may include at least one hollow-type golf club head and at least one cavity-back golf club head. At least two differently-lofted golf club heads of the set each comprise a striking face, a loft, L, a center of gravity spaced from the striking by a depth, Dcg, and a moment of inertia, Izz, about a virtual vertical axis passing through the center of gravity. The following inequality is satisfied: $2.2017*L^2-63.276*L+3500 \leq Izz/Dcg \leq 2.2017*L^2-63.276*L+4200$, wherein: L is measured in degrees, Izz is measured in $g*cm^2$, and Dcg is measured in cm.

These and other features and advantages of the invention in its various aspects and demonstrated by one or more of the various examples will become apparent after consideration of the ensuing description, the accompanying drawings, and the appended claims.

DETAILED DESCRIPTION

The following examples will be described using one or more definitions, provided below.

One goal of a set of irons is to enable a golfer to consistently achieve a desired shot distance in association with a selected loft with adequate dispersion. Accordingly, the set of irons should preferably enable the golfer to achieve shot distances at a relatively consistent increment to provide a versatility necessary for typical course play.

Properly incrementing shot distance and/or feel of golf club heads of a set of golf clubs that are similar in appearance and structure has been carried out with relatively acceptable results. However, in the particular case where golf clubs of a set greatly vary in appearance and/or structure within a set, achieving consistent feel, forgiveness, and distance gapping is a greater challenge.

Recently, for various reasons, golfers have tended toward replacing long irons with hybrid-style or hollow-type irons or utility clubs. Whereas some golfers may struggle with conventionally structured long irons, hybrid style or utility type clubs may provide some advantages. For example, the metal wood structure allows for a striking face with bulge and/or roll, which in combination with the phenomenon of "gear effect" provides greater forgiveness on shots hit off-centered. Furthermore, along similar lines, the larger footprint of these type of clubs naturally imparts greater moment of inertia (MOI), particularly about a virtual vertical axis passing through a center of gravity of the club head. Increasing moment of inertia is generally correlated with increasing the club head's natural resistance to rotation on off-centered golf ball impacts. Finally, some believe that the broader structure of hybrid and utility type club heads improves turf interaction and provides greater stability and consistency in the orientation of the golf club head at impact with a golf ball.

For at least the above reasons, substitution of long irons with hybrid-, hollow-, and/or utility-type golf clubs is gaining in popularity. As a corollary, it is beneficial to design and offer, as a single set, a correlated plurality of golf clubs that are "mixed," i.e. contain one or more hybrid-, hollow-, and/or utility-type golf clubs and one or more traditionally-shaped golf club, e.g. of a solid cavity-back or blade-type structure.

Figure 1:
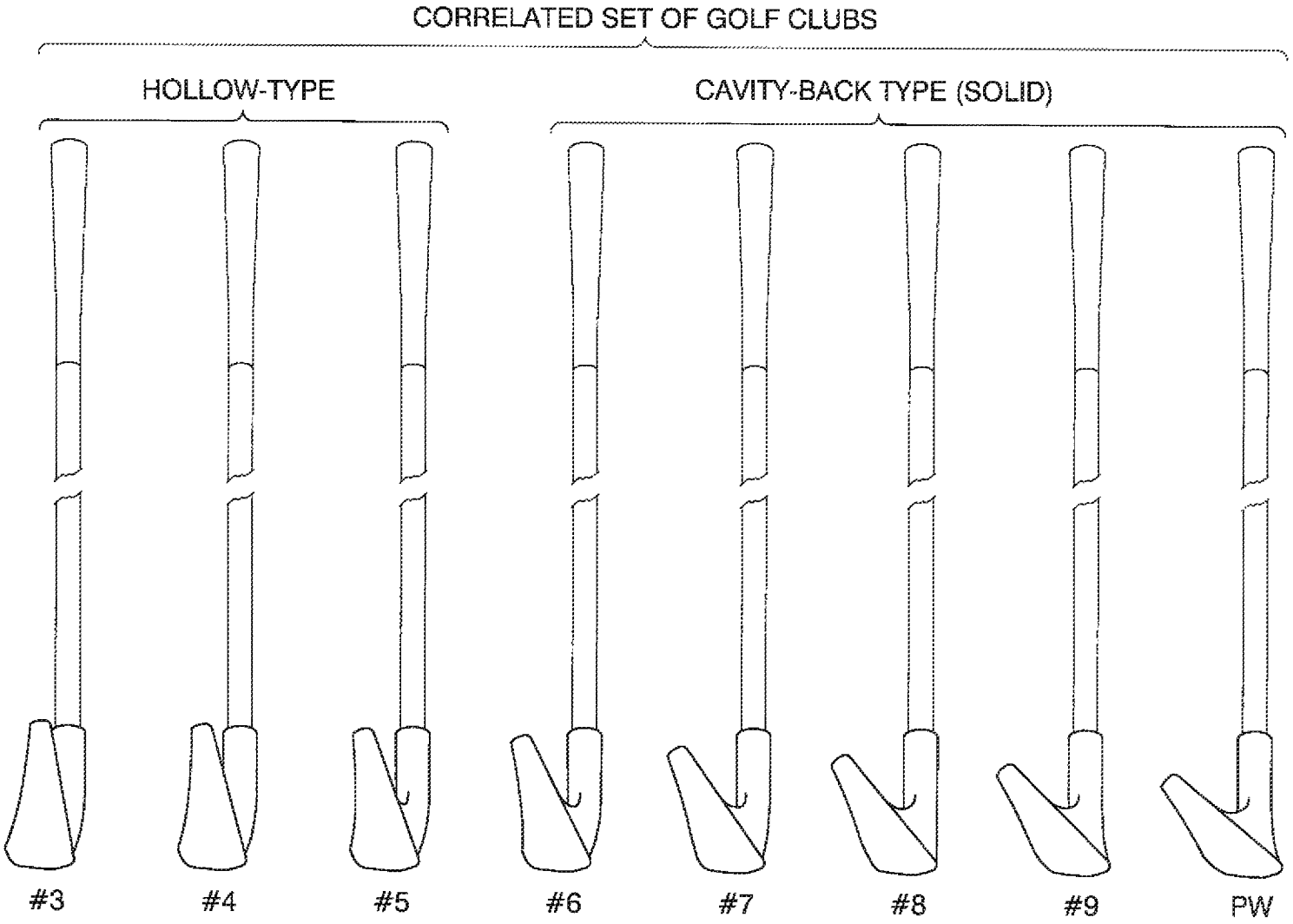
FIG. 1 shows a golf club set in accordance with one or more aspects of the present disclosure.
Figure 2:
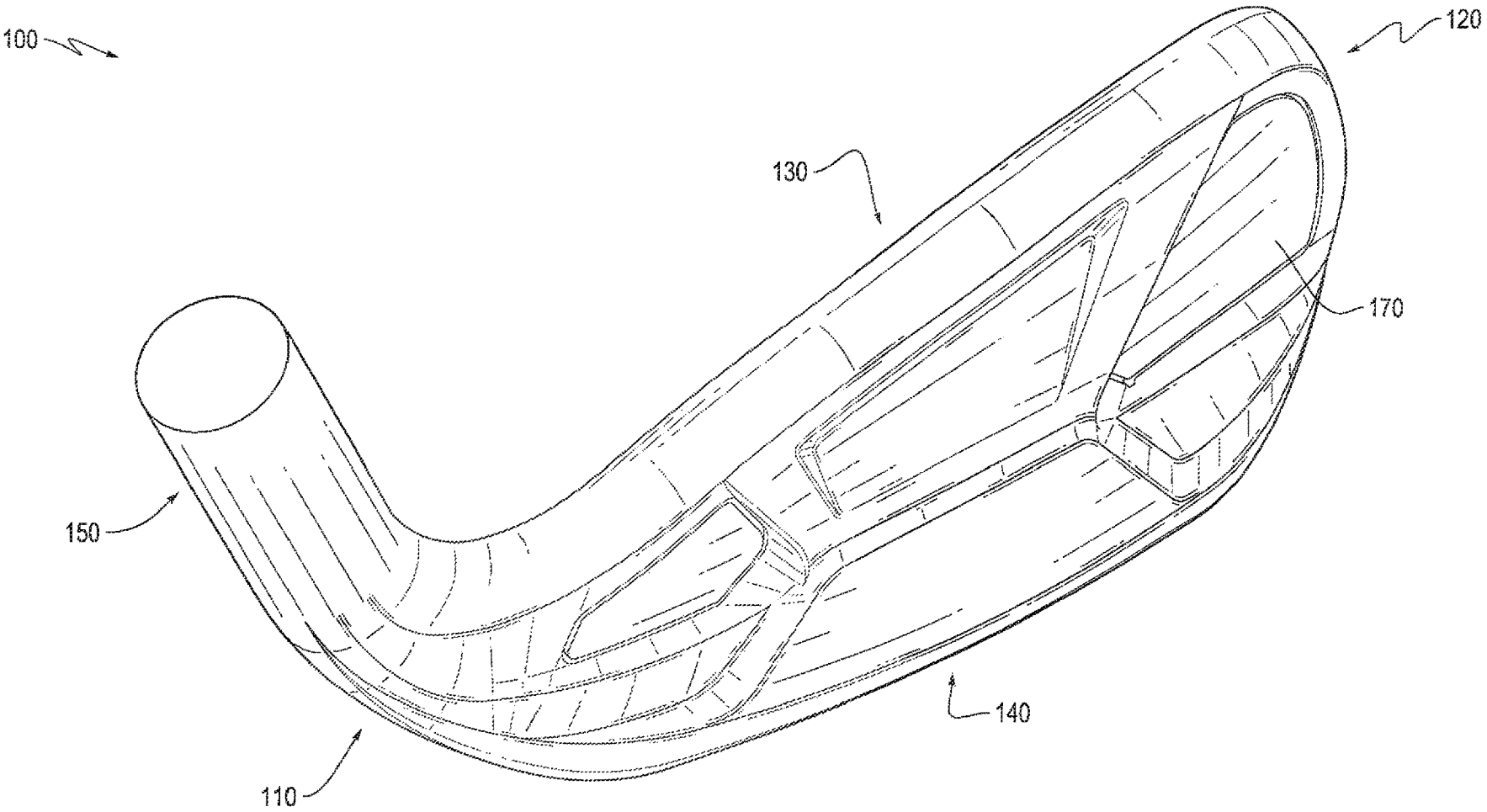
FIG. 2 shows a rear perspective view of a golf club head in accordance with one or more aspects of the present disclosure.
Figure 3:
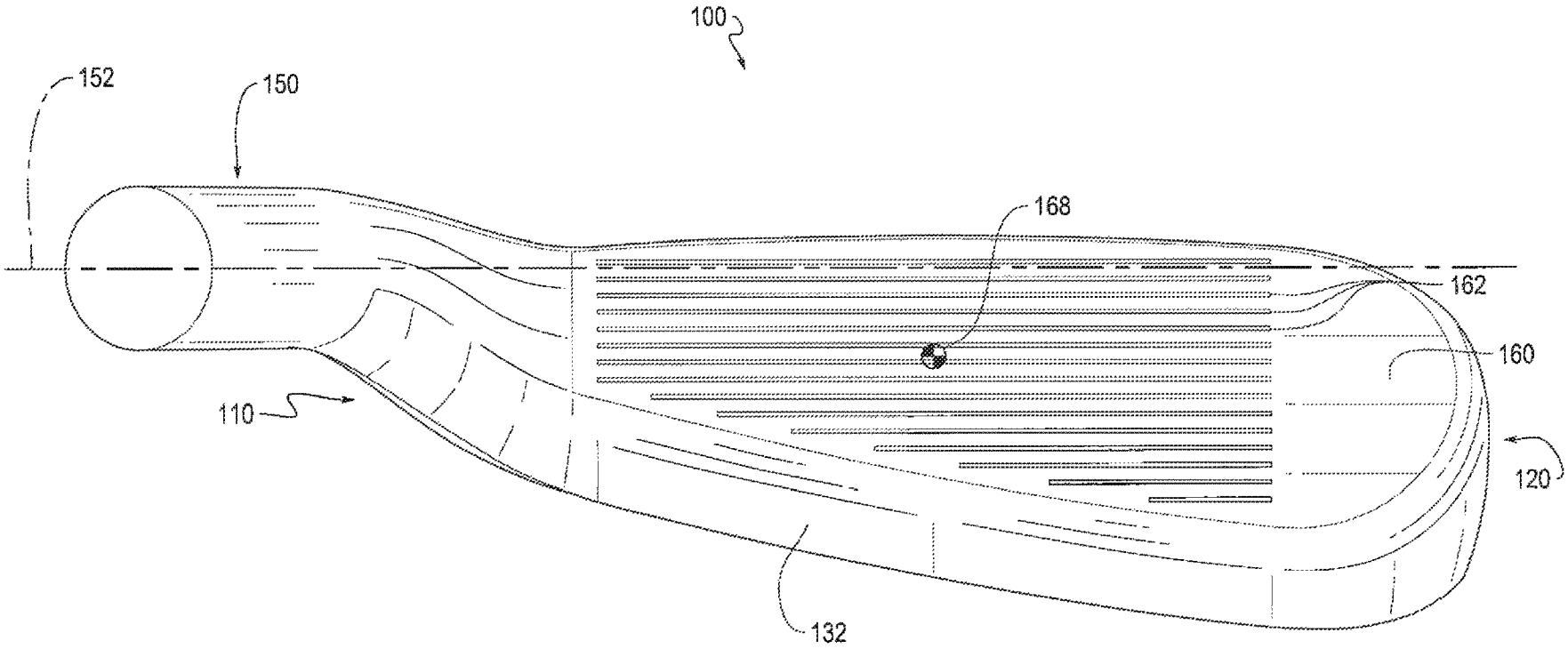
FIG. 3 shows a top view of the golf club head of FIG. 2.

Referring to FIG. 1, one such golf club set is shown. The shown golf clubs constitute a correlated set of golf clubs and thus contain therewithin a set of golf club heads each secured to a golf club shaft. The set includes golf clubs ranging from a #3 iron to PW (pitching wedge). However, in other embodiments, these numerical designations may vary either including additional clubs or excluding one or more clubs, e.g, a set of clubs ranging from #4-iron through PW. Each club comprises a club head of a distinct loft among the set and that varies progressively with increasing number designation. Exemplary loft values are provided in Table #1 below, but may vary by plus or minus 3 degrees e.g. for purposes of customization.

TABLE #1

| Loft by Iron Numerical Designation | |
|---|---|
| Iron Number | Loft |
| 3 | 20 |
| 4 | 25 |
| 5 | 28 |
| 6 | 31 |
| 7 | 34 |
| 8 | 37 |
| 9 | 41 |
| PW | 46 |

Preferably, at least one, more preferably at least two, and most preferably at least three of the club heads of the set constitute hollow-type, hybrid-type, or utility-club type club heads (collectively referred to as hollow-type irons herein). Additionally, such hollow-type club heads preferably constitute the lowest-lofted (i.e. longest) iron club heads of the set. Likewise, preferably, at least one, more preferably at least two, and most preferably at least three of the club heads of the set constitute cavity back (and also preferably solidly formed or non-hollow) club heads. In similar manner, the cavity-back club heads preferably constitute the higher-lofted club heads of the set. For example, the #3 through #5 constitute hollow-type irons, while the #5 through PW constitute cavity-back (and solid) irons.

As described above, various advantages arise from substituting low-lofted irons with hollow-type club heads. However, along with such advantages to such substitution, various detriments may naturally arise such as greater distinction in the feel, forgiveness and shot distance achievable between hollow type club heads and cavity-back club heads thereby presenting shortcomings in the playability of the set as a whole that may hinder a golfer's success and focus throughout the game.

One particular need identified as alleviating such shortcomings is to increase discretionary mass. As used herein, provided a specified mass budget for a club head, some proportion of the specified mass must be relegated to structural mass, i.e. the minimum necessary amount of mass necessary to establish the club head's structural integrity. The remaining mass, e.g. the difference between a prescribed mass budget and structural mass may be considered discretionary mass. Discretionary mass may be considered mass which may function primarily to affect the overall mass properties of the club head, e.g. location of a center of gravity, MOE, principle axes of inertia, etc., as will be described in further detail below.

One area of particular interest for mass relocation is mass associated with forming a striking wall of the club head. On one hand, mass removal from the striking wall may result in greater performance (e.g. average shot distance). On another hand, as the striking wall generally constitutes the front portion of the club head, mass removal and relocation therefrom would likely naturally cause the center of gravity to move further rearward. This may be advantageous in and of itself in that a rearward center of gravity may be considered preferable in terms of spin generation, dynamic loft and a higher sweet spot location. Furthermore, all else being equal, shifting the center of gravity further rearward generally results in a greater MOI, particularly about a virtual vertical axis passing through the center of gravity of the club head (i.e. Izz).

For these reasons, one or more club heads, and preferably the hollow-type irons, of the set include a striking wall having non-uniform face thickness, particularly configured in a manner that minimizes unnecessary mass, facilitates machining, and maintains or improves performance (e.g. shot distance).

A hollow-type club head 100 (in particular the #3 iron) is shown in FIGS. 2-7 and preferably embodies a variable thickness striking wall pattern believed to meet the above criteria. The golf club head includes a heel portion 110, a toe portion 120 opposite the heel portion, a top portion 130, and a sole portion 140 opposite the top portion. The top portion 130 includes a top line 132. The hosel 150 defines a virtual central hosel axis 152 (see FIGS. 3 and 4)

Figure 4:
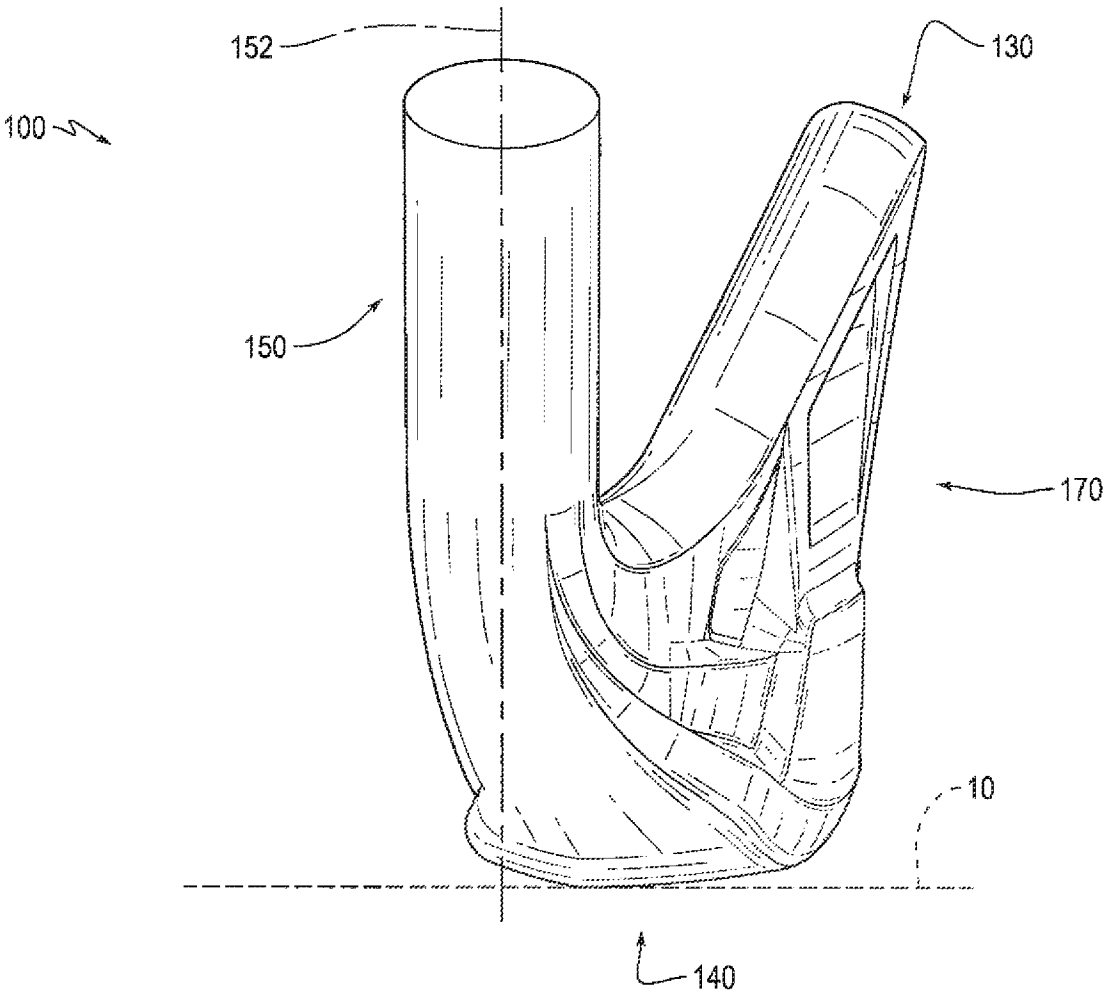
FIG. 4 shows a heel side elevation view of the golf club head of FIG. 2.
Figure 5:
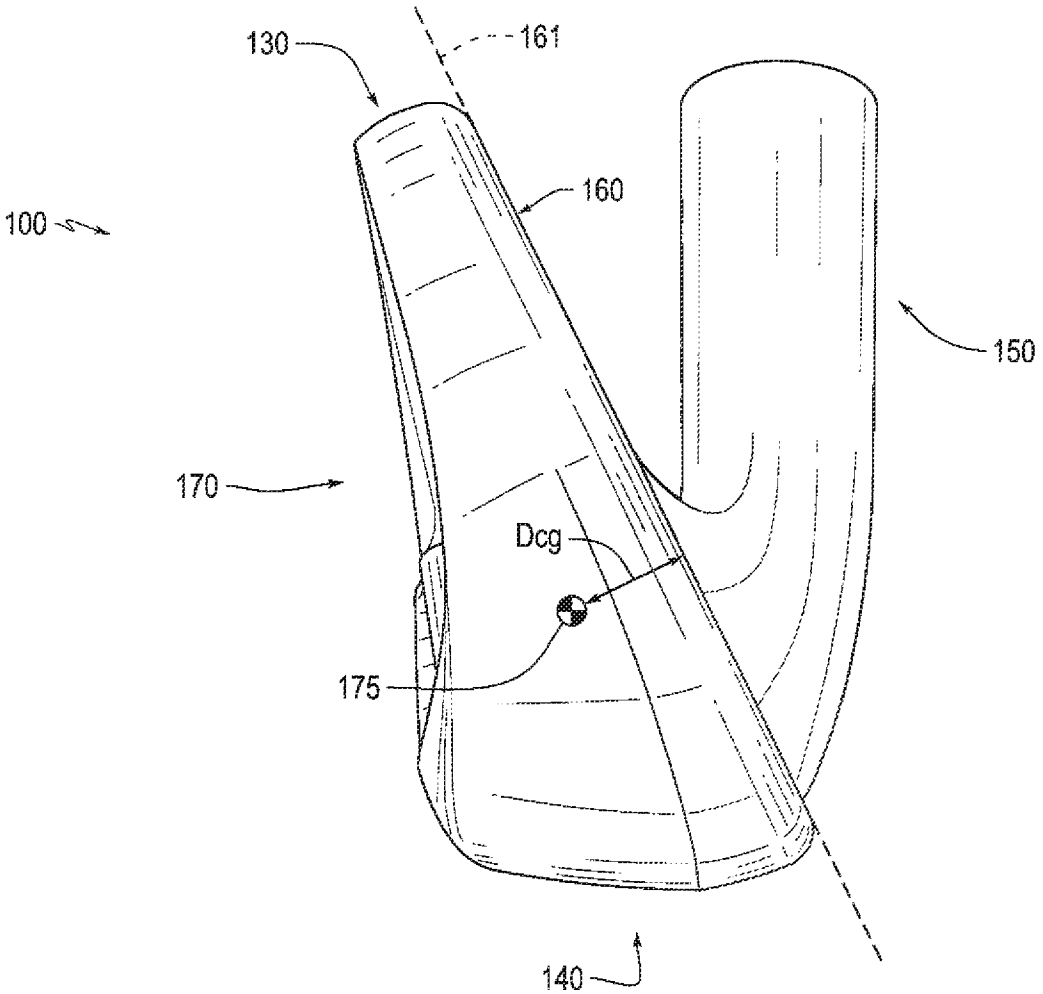
FIG. 5 shows a toe side elevation view of the golf club head of FIG. 2.

Unless otherwise specified, all aspects of the club heads shown and described herein are defined with the club head oriented in a reference position relative to a virtual ground plane 10 (see FIG. 4). The reference position refers to the position of the club head in which the sole portion rests on the ground plane such that the hosel axis lies at a designated lie angle of the club head relative to the virtual ground plane and such that the scorelines (described later) are parallel with the virtual ground plane.

Figure 6:
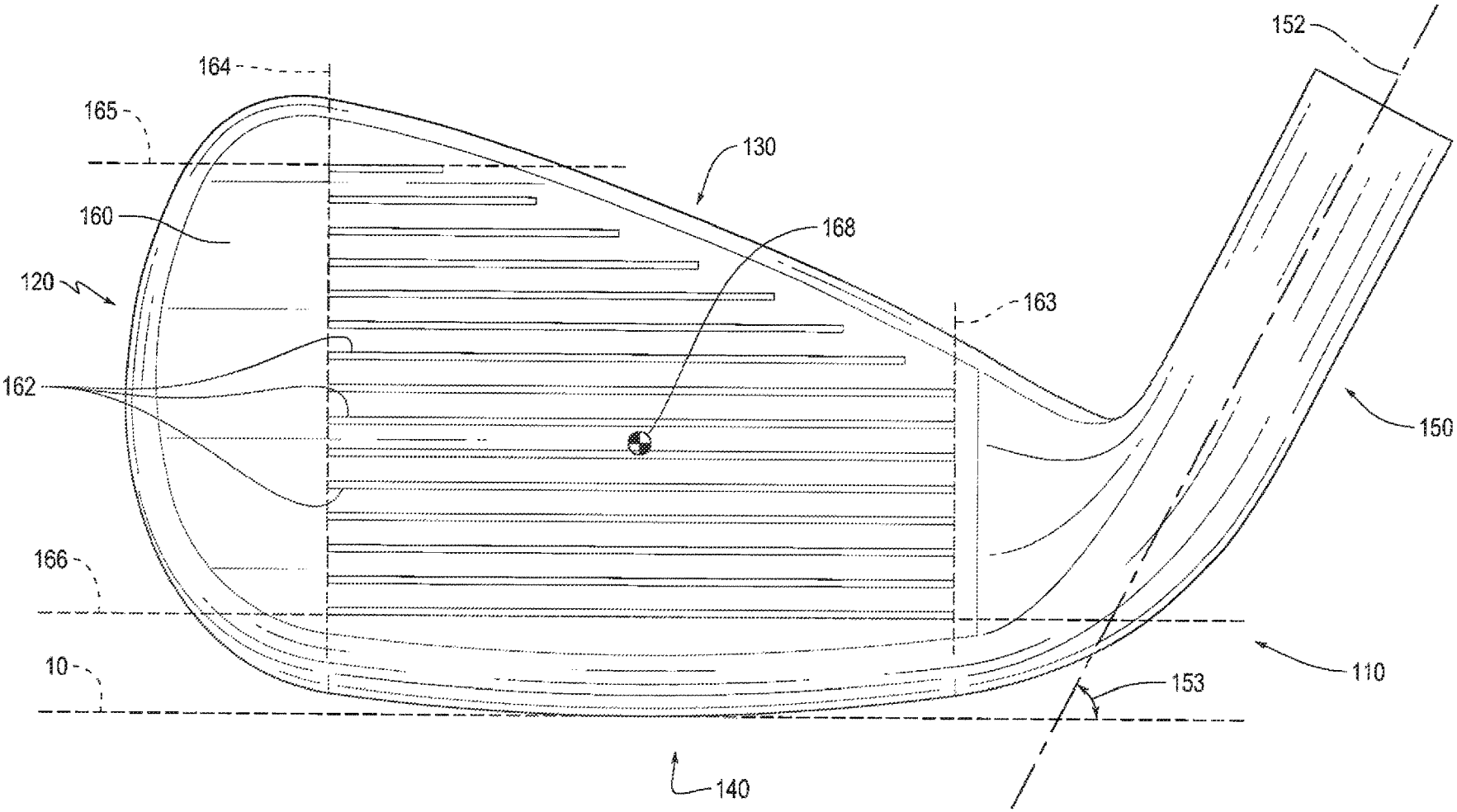
FIG. 6 shows a front elevation view of the golf club head of FIG. 2.
Figure 7:
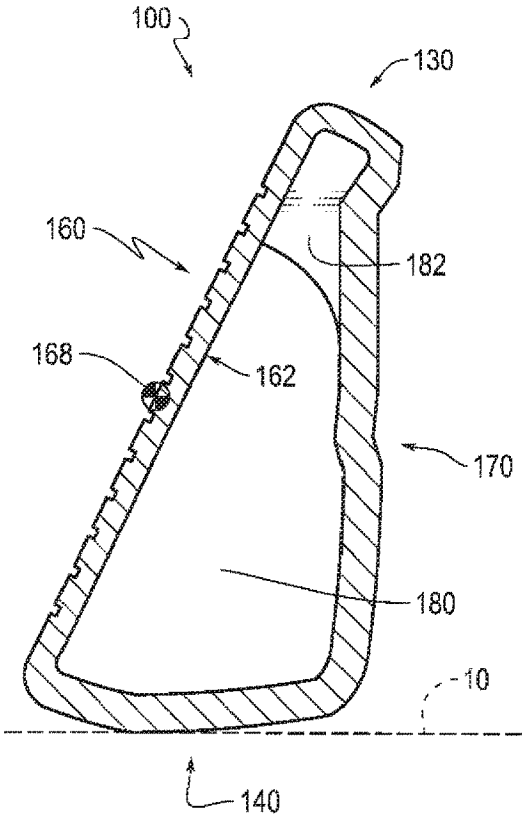
FIG. 7 shows a cross-section of the golf club head of FIG. 2.

Referring specifically to FIGS. 6 and 7, the hosel axis 152 and ground plane 10 may define a lie angle 153. The striking wall includes a forward-facing striking face 160 configured to impact a golf ball in the course of play. The striking face 160 may define a striking face plane 161. The striking wall further includes a rear surface 162 (FIG. 7) opposite the striking face. The rear surface 162, the top portion 130, the sole portion 140 and the rear portion 170, in combination may form an at least partially, preferably fully, enclosed interior chamber 180. In some embodiments such chamber may be at least partially or entirely filled with a filler material, preferably comprised of a material having a density no greater than, and preferably less dense than, a second different material comprising the main body of the club head (i.e. the combined portions of the striking wall, top portion, rear portion, and sole portion). In some embodiments, different materials may additionally constitute the various portions of the main body, for example in which the striking wall includes a face insert securable (preferably permanently but in some embodiments removably) to the remainder of the main body, i.e. a return portion. In such cases, the striking wall insert preferably comprises a third material that is less dense than a material forming the majority or entirety of the return portion.

The interior cavity 180 of one or more of the hollow-type club heads may include one or more ribs 182 secured to either an interior surface of the top portion, the sole portion and/or extending entirely from the top portion to the sole portion. Such ribs may be beneficial in improving the structural stability of the club head and tuning sound and vibratory emanations of the club head which may result from impact with a golf ball during the course of play.

Preferably, the striking face, in embodiments in which it comprises a discrete, separate, and optionally aft-attached component, comprises a high-strength steel, e.g. HT-1.770 steel. However, other alternatives may also be suitable.

The filler material, in such embodiments (and not shown), may comprise a lightweight metal, e.g. aluminum, and/or a polymeric material such as an elastomer, open or closed cell foam, ionomer, polyurethane, PBAX, or resin. The main body preferably comprises a stainless steel but may alternatively comprise titanium.

The striking face preferably includes a plurality of scorelines 162 for purposes of alignment and removal of debris and/or increasing backspin and/or consistency of a golf shot. The scorelines define a heelward extent 163, a toe-ward extent 164, an upper extent 165, and a lower extent 166. The striking face further defines a face center 168 being the point along the face laterally equidistant between the heel-ward extent and the toe-ward extent and vertically equidistant between the upper extent and the lower extent.

Figure 8:
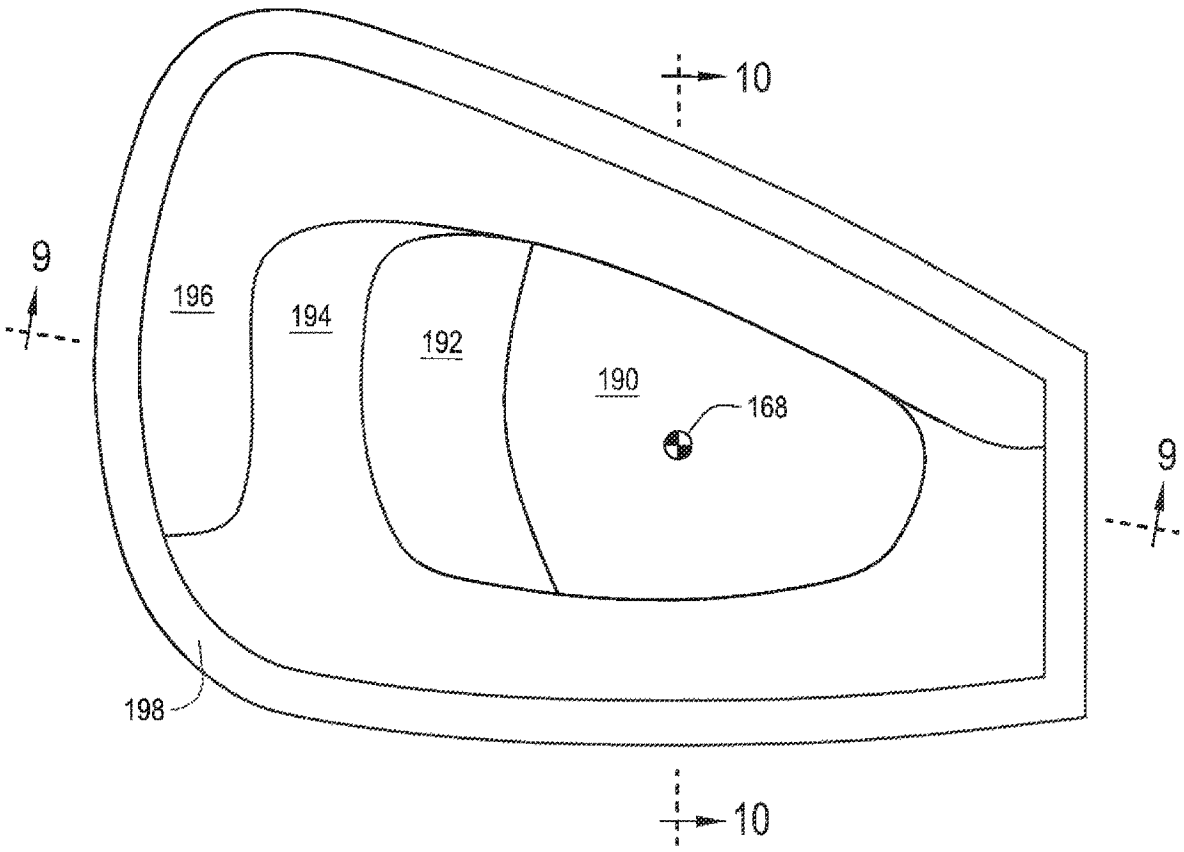
FIG. 8 shows a variable thickness profile of the striking wall of the golf club head of FIG. 2.

As described above, and with reference to FIG. 8, the striking wall preferably comprises a variable thickness profile for optimizing the use of structural mass. In particular, the variable thickness profile may be described as a plurality of regions of the striking wall each of substantially constant thickness. As shown, thickness of the striking wall generally increases toward the center of the face 168, forming a central thickened region, the maximum thickness occurring at region 190 (preferably 2.5 mm). The thickness of the face generally decreases in a direction outward from the region 190, whereby region 192 preferably has a thickness 2.4 mm, region 194 preferably has a thickness of 23 mm, and region 196 (i.e. a peripheral region) preferably has a thickness of 2.2 mm. In some embodiments, thickness entirely decreases outward of the face center in all directions. However, preferably a thickened perimeter region 198 preferably includes a thickened region of 2.4 mm. Such thickening may improve adhesion of the striking face insert with the main body and improve structural stability.

Figure 9:
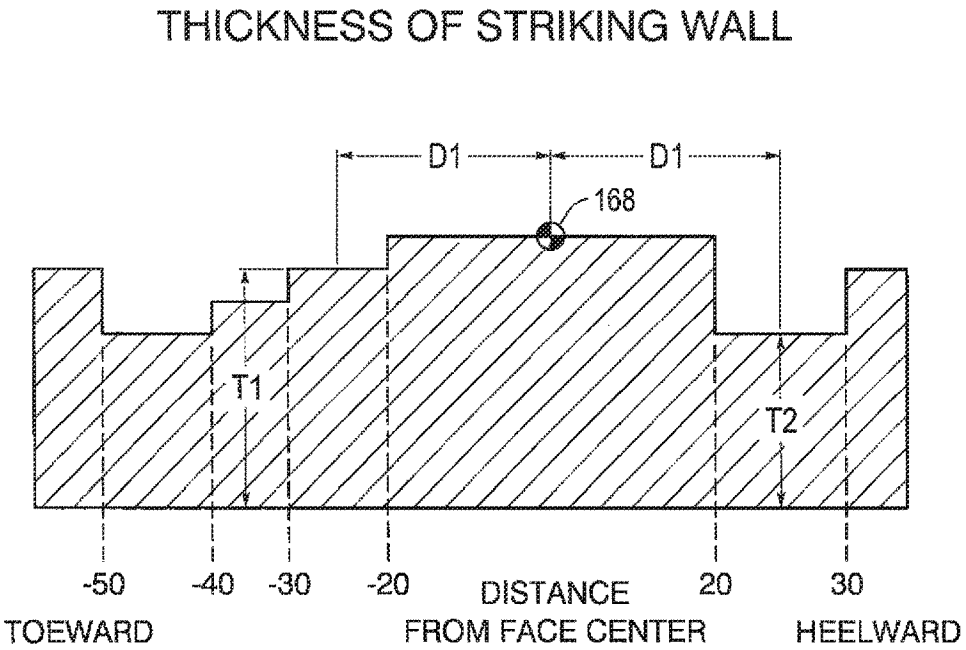
FIG. 9 shows a horizontal cross-section through the face center of the striking wall shown in FIG. 8.

Notably, the degree of tapering of thickness outward of the face center 168 is asymmetric in both the heel-to-toe (lateral) direction as well as the vertical direction (in this case, vertical being considered with the striking face rotated to be parallel with the plane of the paper). Referring to FIG. 9, which shows a detail of a horizontal cross-section through the face center, thickness tapers in step-wise fashion outward of the face center. In alternative embodiments, the taper may be a smooth transition or may contain steps that have an angled draft angle, say of 5-45 degrees and/or a step following a sine curve, i.e. inflected.

Preferably, at a location within 20 mm from the face center, more preferably within 15 mm from the face center, the striking wall exhibits a maximum thickness (e.g. 2.5 mm). Additionally, at a location spaced laterally toe-ward from the face center by a distance D1 of 20 mm to 30 mm, more preferably 22 mm to 28 mm, and most preferably about 25 mm, the striking wall exhibits a first thickness T1 of 2.4 mm, whereas at a same lateral distance M heel-ward of the face center, the striking wall exhibits a thickness T2 less than T1, preferably by at least 0.05 mm. T2 is preferably equal to about 2.3 mm.

Figure 10:
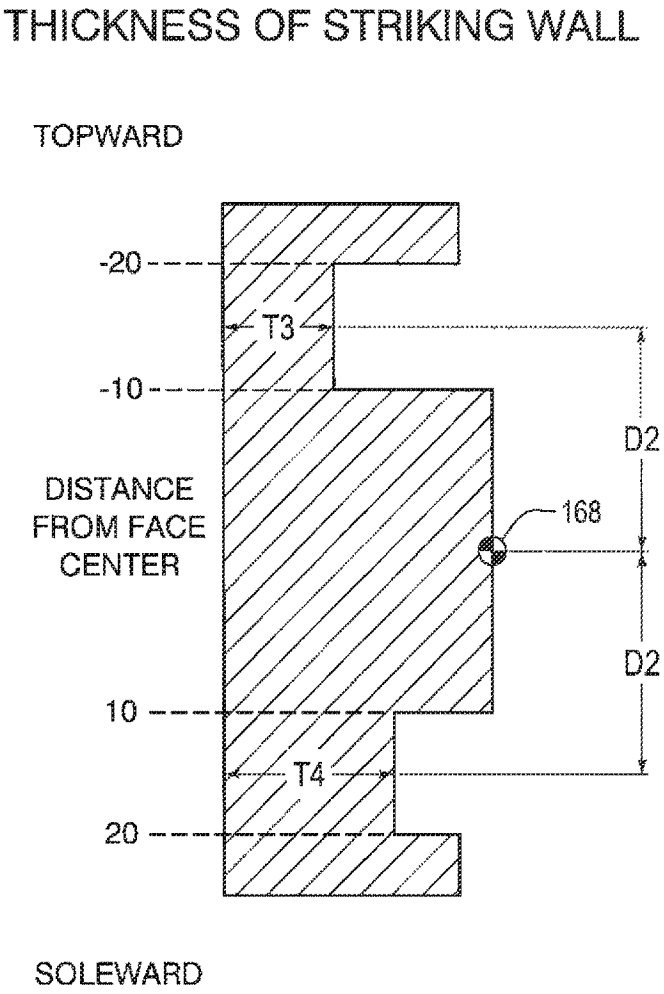
FIG. 10 shows a vertical cross-section through the face center of the striking wall shown in FIG. 8.

As shown in FIG. 10, vertically along the striking face, at a third location being above the face center by a distance D2 of between 10 and 20 mm, more preferably between 12 and 18 mm, and most preferably equal to about 15 mm, the striking wall exhibits a third thickness T3 of about 2.2 mm. At a fourth location vertically along the striking face and below the face center by the distance D2, the striking wall exhibits a fourth thickness T4 that is greater than 13, preferably by at least 0.05 mm, more preferably by at least 0.075 mm.

In addition to the above attributes, or alternatively, the striking wall exhibits a minimum thickness Tmin no greater than 2.5 mm, more preferably no greater than 2.3 mm, and most preferably equal to or about 2.2 mm. Additionally, the striking wall preferably exhibits a central thickened portion that contains of itself a maximum thickness Tmax that is greater that Tmin by at least 0.20 mm, more preferably by at least 0.25 mm. Tmax may additionally correspond to the maximum thickness of the striking wall as a whole. Preferably, Tmax in any such case is no greater than 2.75 mm.

As described above, the variously described variable thickness striking wall embodiments beneficially remove mass from the striking face in a manner that may preserve the structural integrity and performance characteristics of the face. Such removal increases the overall discretionary mass of the golf club heads, which is particularly significant for hollow-type low-lofted irons, so that such mass may be employed to adapt the feel of these clubs to better match that of the higher-lofted cavity-back club heads e.g, in terms of vibratory characteristics, moment of inertia, and distance gapping, collectively considered "blending." Furthermore, the hollow-type club heads of the set may be better adapted to make use of discretionary mass in that greater space is available within the interior cavity for re-location of mass via integrally thickened regions and/or weight inserts poured therein and/or welded/brazed or other adhered thereon. On the other hand, the cavity-back type club heads, by virtue of their structure may particularly benefit from an insert or plaque positioned on the rear surface of each striking wall. Such plaque may beneficially absorb vibration upon impact or as clubs may interact when stored in a golf bag. For such reasons, a variable face thickness pattern as described above with particular regard to the hollow-type club heads may additionally be considered particularly non-preferable with regard to the cavity-back type club heads in that they may result in difficulties in adhesion between such plaque or insert and the rear surface of the striking face.

In terms of such blending, as a threshold matter, moment of inertia of the club head (i.e. the club head's resistance to rotation on off-centered shots) is preferably maintained relatively consistent from club head to club head throughout the set. Izz of at least two, more preferably at least three, and most preferably for each club head of the set, is preferably at least 2525 g*cm$^2$ more preferably between about 2525 g*cm$^2$ and 2800 g*cm$^2$.

Figure 11:
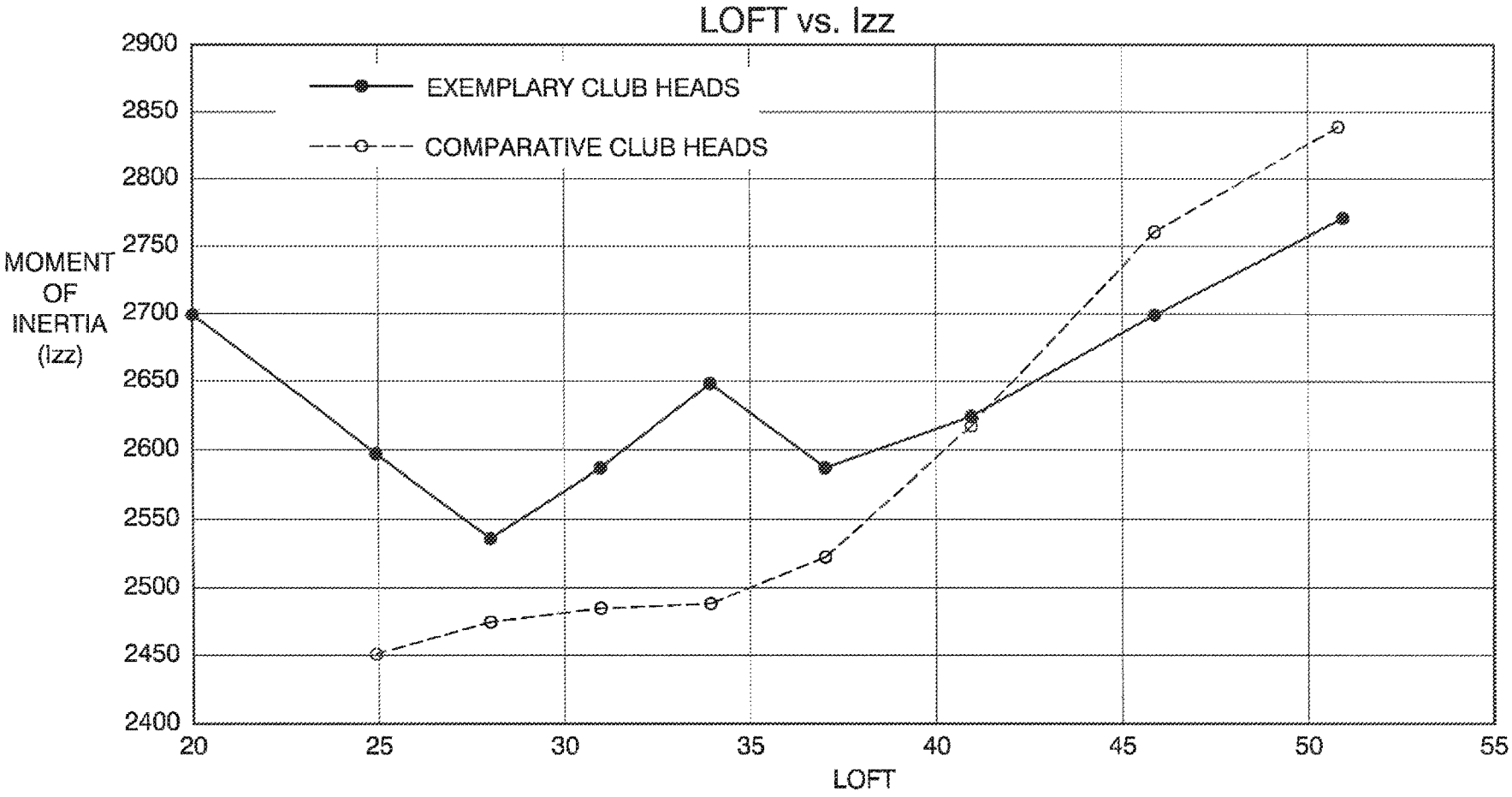
FIG. 11 shows a plot of variation in moment of inertia (Izz) vs, loft.

Additionally, or alternatively, such Izz preferably does not significantly vary between club heads throughout the set. In other words, the standard deviation of Izz values for all club heads in the set is preferably no greater than 100 g*cm, more preferably no greater than 80 g*cm$^2$, and even more preferably no greater than 75 g*cm$^2$. A plot of variation in Izz in the club heads according to the present disclosure and in comparative club heads is shown on the chart presented in FIG. 11.

Moment of inertia, considered in isolation, may be a useful attribute in blending a set of irons sufficiently to satisfy golfers' perceptions. However, through empirical study, the present inventors believe that an even more effective measure of blended-ness lies in considering the combination of moment of inertia and location of the center of gravity 175 (see FIG. 5), particularly its depth Dcg (rearward spacing) relative to the striking face of the club head.

Accordingly, in combination of, or alternatively to, the above MOI attributes, the golf club heads of the set preferably satisfy various relationships governing CG location thereof.

In particular, at least two, preferably at least three, and more preferably each, of the club heads of the set of golf club heads have their centers of gravity 175 positioned in such manner to satisfy the following equation (where loft is in degrees and Dcg is in mm):

$$Dcg \geq -0.0648*L+7.6.$$

Figure 12:
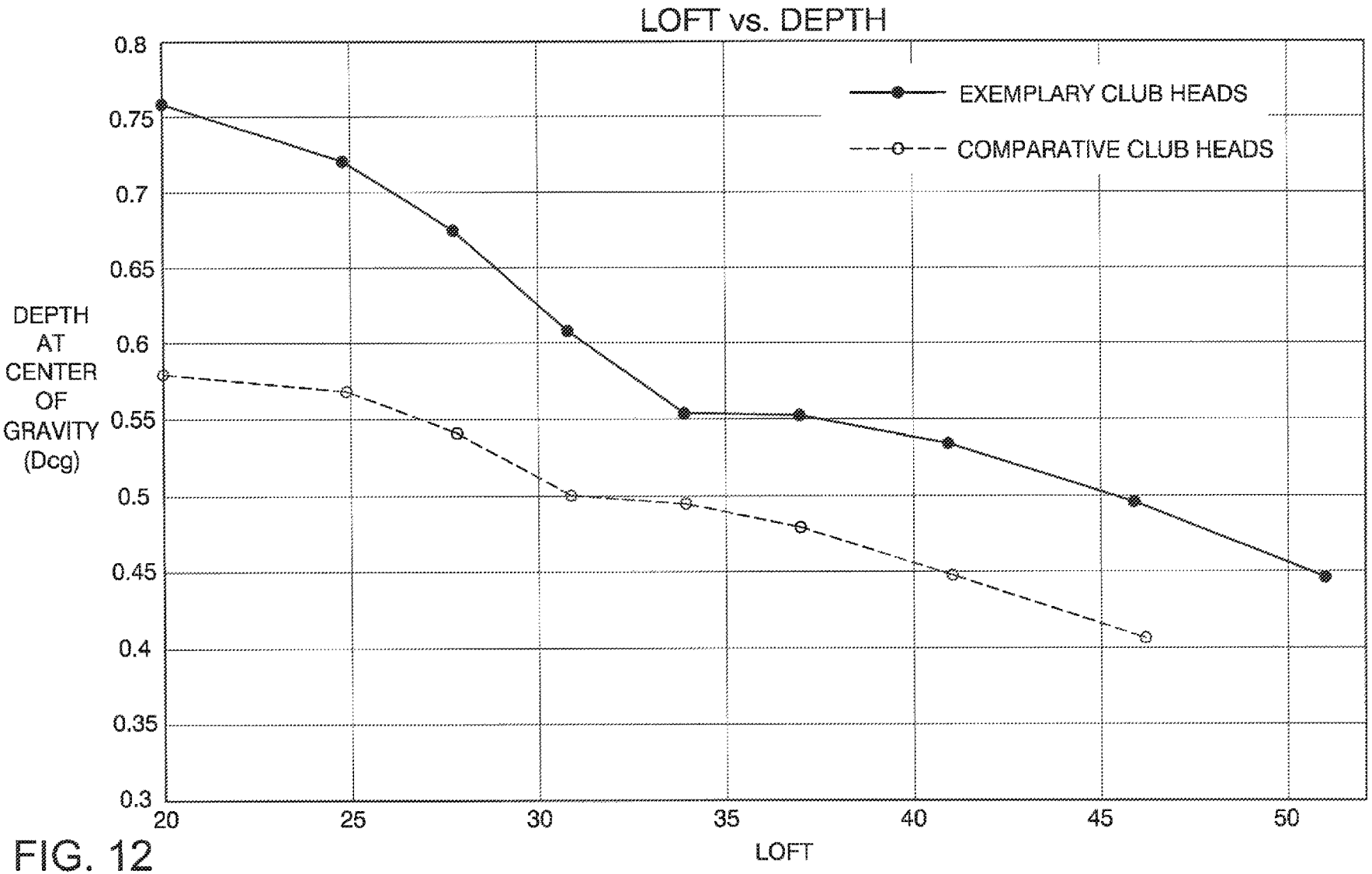
FIG. 12 shows a plot of variation in depth of center of gravity (Dcg) vs. loft.

An exemplary graph showing Dcg values correlated with loft for each club head of the set of club heads of the embodiment of FIG. 1 is shown in FIG. 12.

Further, in addition to any of the above embodiments, a ratio of Izz to Dcg is preferably particularly considered in achieving a set of mixed club heads having both hollow-type club heads and solid, cavity-back type club heads. For example, preferably at least two, more preferably at least three, and most preferably all, club heads of the set of iron-type club heads is configured to satisfy the following relationship (where Izz is in g*cm$^2$, Dcg is in cm, and loft is in degrees):

$$Izz/Dcg \leq 2.2017*L^2-63.276*L+4200.$$

More preferably, at least two, more preferably at least three, and most preferably all, clubs heads of the set of iron-type club heads is configured to satisfy the following relationship (where Izz is in g*cm$^2$, Dcg is in cm, and loft is in degrees):

$$2{,}2017*L^2-63.276*L+3500 \leq Izz/Dcg \leq 2.2017*L^2-63.276*L+4200.$$

Even more preferably, at least two, more preferably at least three, and most preferably all, club heads of the set of iron-type club heads are configured to satisfy the following relationship (where Izz is in g*cm$^2$, Dcg is in cm, and loft is in degrees):

$$2.2017*L^2-63.276*L+3600 \leq Izz/Dcg \leq 2.2017*L^2 63.276*L+4000.$$

Figure 13:
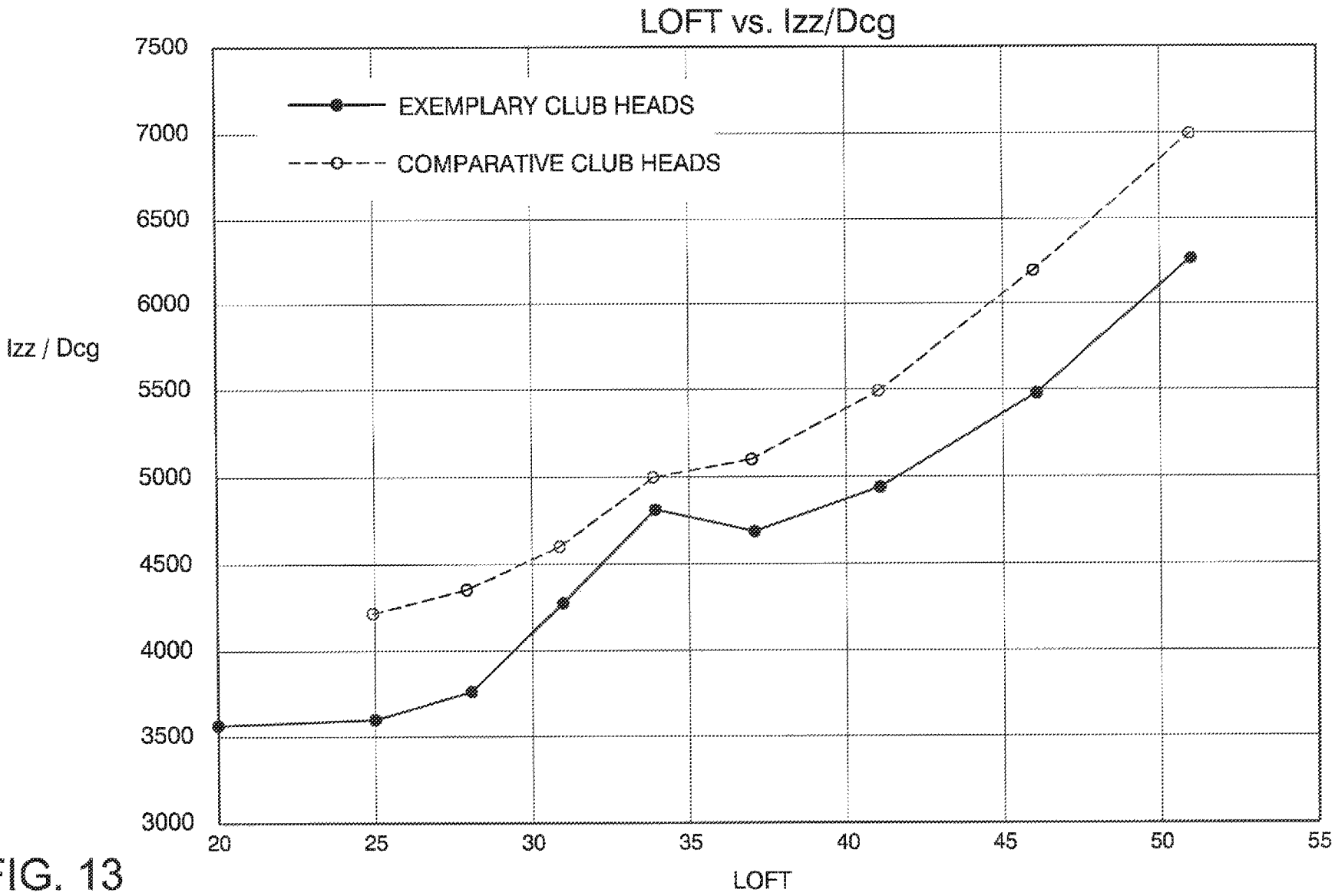
FIG. 13 shows a plot of variation in Izz/Dcg vs. loft.

An exemplary graph showing Izz/Dcg values correlated with loft for each club head of the set of club heads of the embodiment of FIG. 1 is shown in FIG. 13.

Table #2 below is an exemplary table providing such attributes for one embodiment of the present disclosure:

TABLE #2

| | | Exemplary Set of Golf Club Heads | | | Comparative Set of Golf Club Heads | | |
|---|---|---|---|---|---|---|---|
| Loft | Iron # | D (cm) | Izz (g * cm2) | Izz/Dcg (g * cm) | D (cm) | Izz (g * cm2) | Izz/Dcg (g * cm) |
| 20 | 3 | 0.754 | 2697 | 3576.92 | — | — | — |
| 25 | 4 | 0.719 | 2598 | 3613.35 | 0.58 | 2450.00 | 4238.75 |
| 28 | 5 | 0.672 | 2538 | 3776.79 | 0.57 | 2475.00 | 4375.11 |
| 31 | 6 | 0.605 | 2587 | 4276.03 | 0.54 | 2485.00 | 4611.25 |
| 34 | 7 | 0.551 | 2651 | 4811.25 | 0.50 | 2490.00 | 4986.98 |
| 37 | 8 | 0.551 | 2586 | 4693.28 | 0.49 | 2520.00 | 5102.25 |
| 41 | 9 | 0.532 | 2625 | 4934.21 | 0.48 | 2620.00 | 5490.36 |
| 46 | PW | 0.494 | 2700 | 5465.59 | 0.45 | 2760.00 | 6181.41 |
| 51 | GW | 0.444 | 2772 | 6243.24 | 0.41 | 2840.00 | 6988.19 |

In another embodiment of the present disclosure, a set of irons (e.g. designations of #3 through PW) includes a full set of hollow-type club heads, one exemplary club head of such set shown in FIGS. 14-22, Such a set, i.e. a set composed fully of or a majority of hollow-type club heads may be particularly suited for high-handicapped golfers and may be considered as "game improvement" irons.

Figure 14:
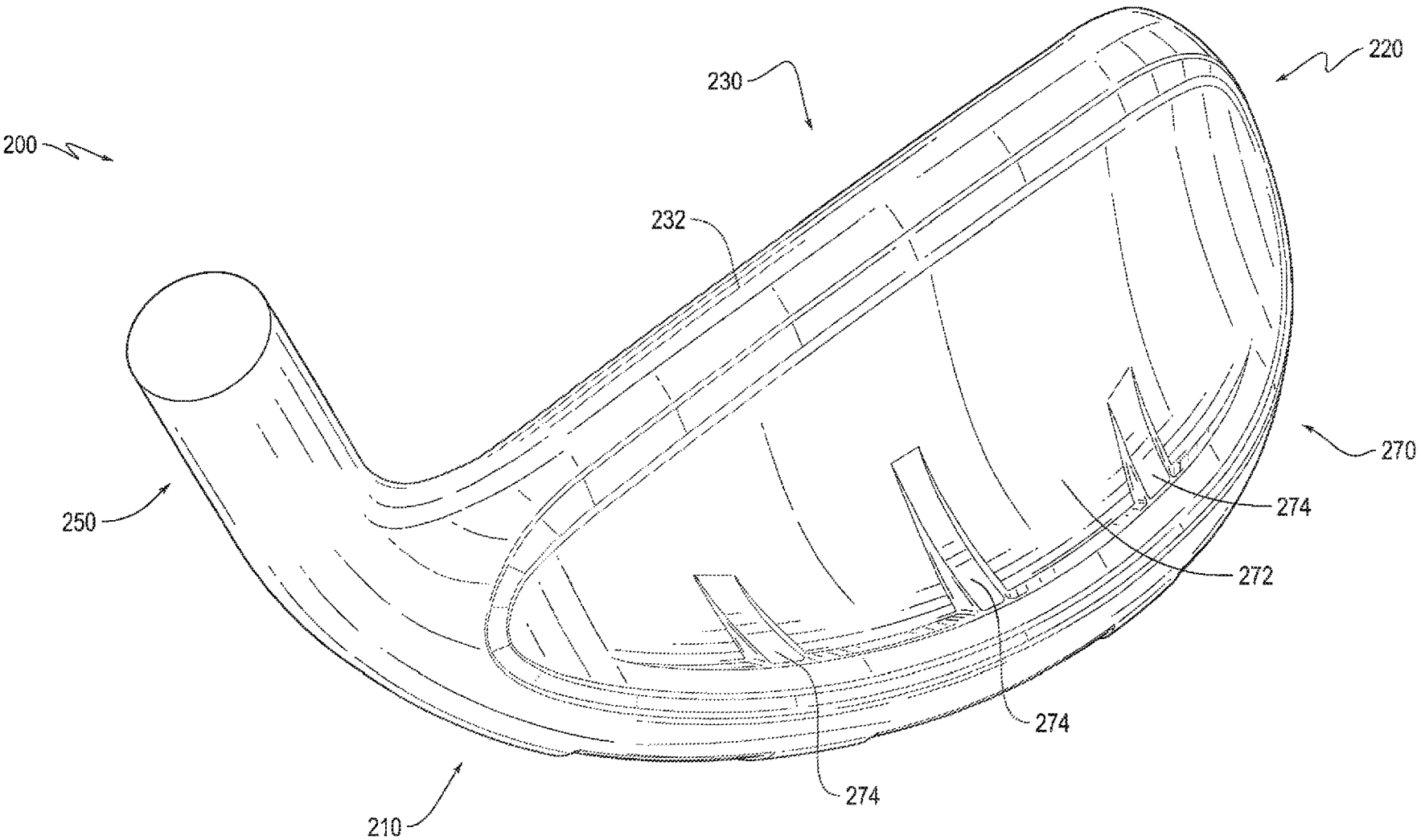
FIG. 14 shows a rear perspective view of another golf club head in accordance with one or more aspects of the present disclosure.
Figure 15:
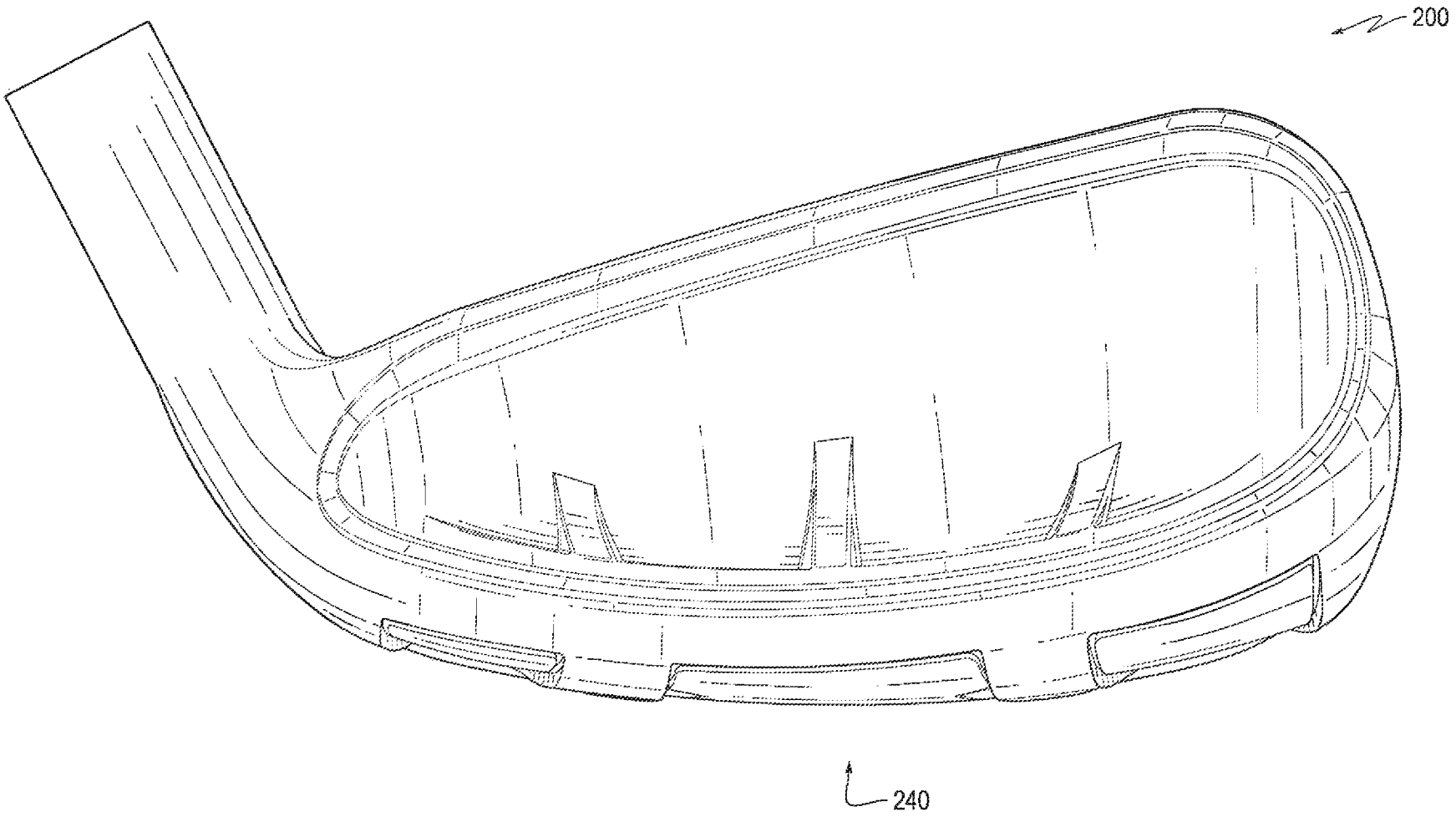
FIG. 15 shows a rear elevation view of the golf club head of FIG. 14.
Figure 16:
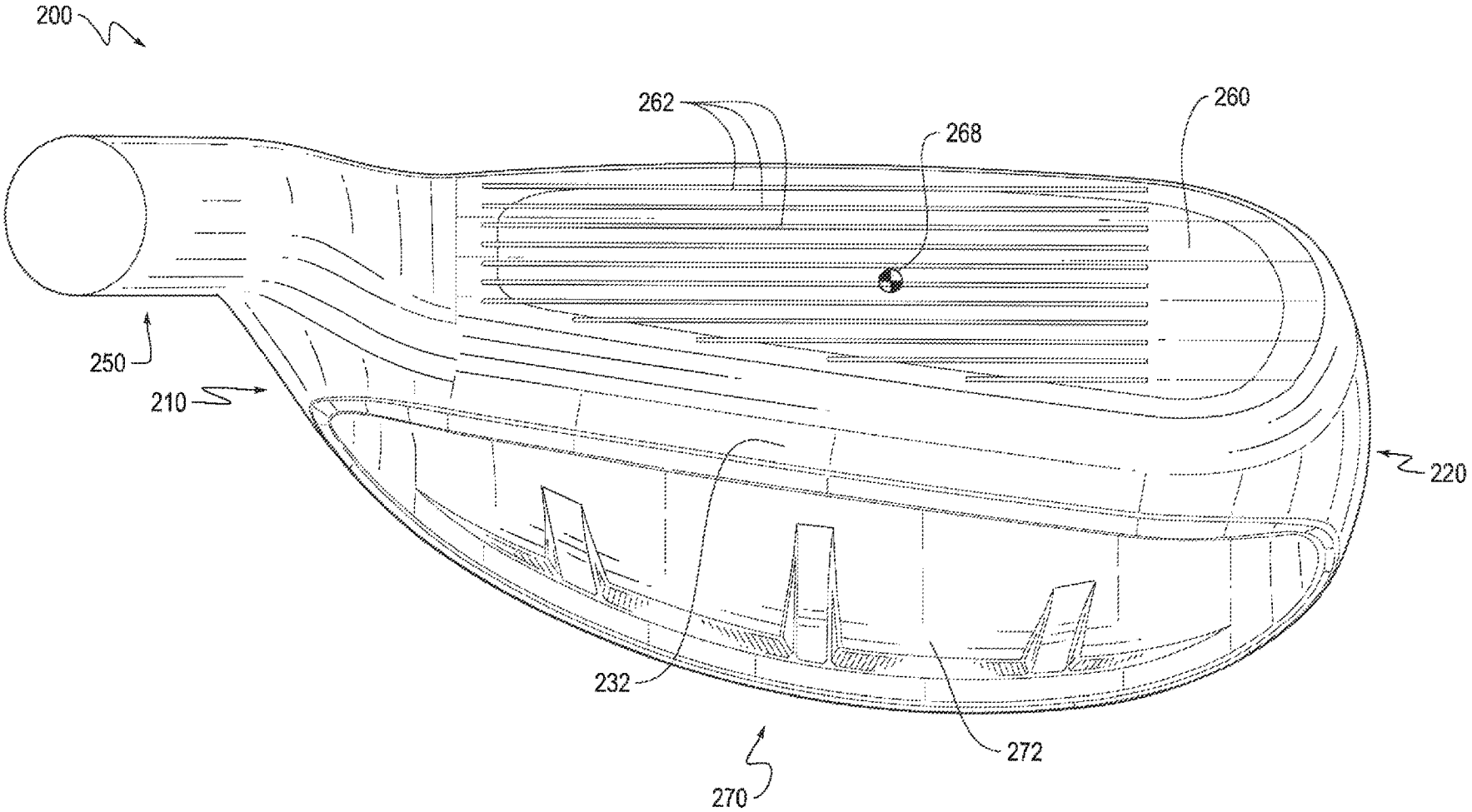
FIG. 16 shows a top view of the golf club head of FIG. 14.
Figure 17:
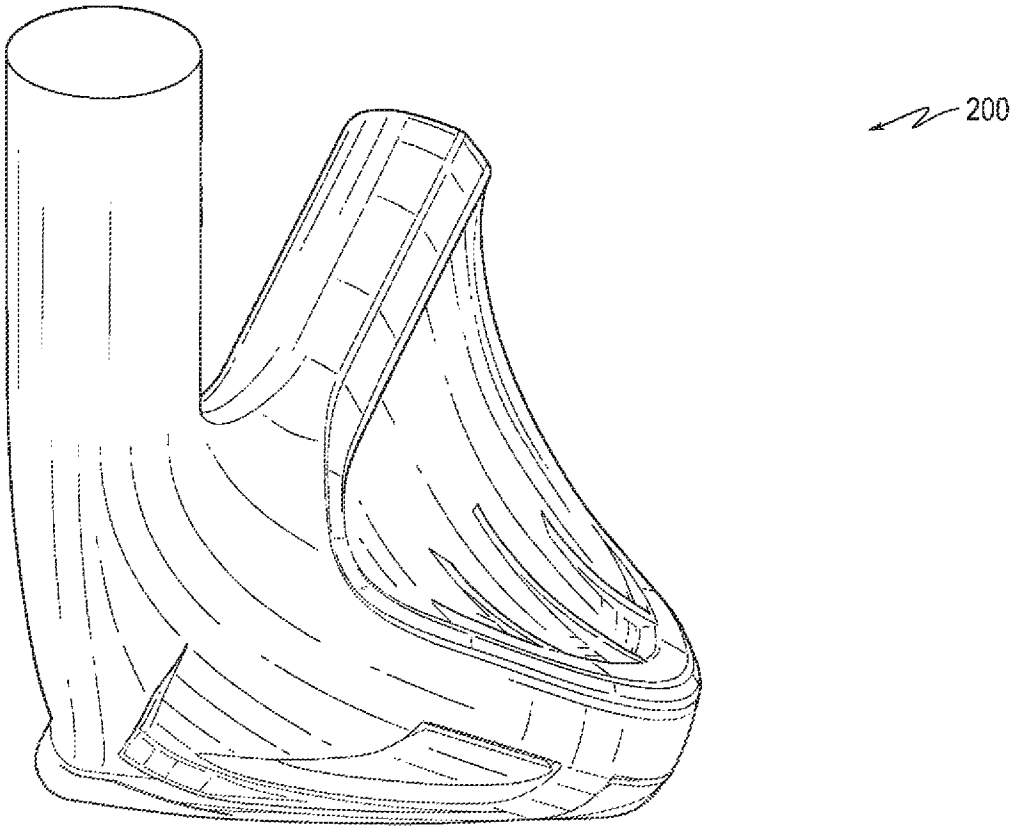
FIG. 17 shows a heel side elevation view of the golf club head of FIG. 14.
Figure 18:
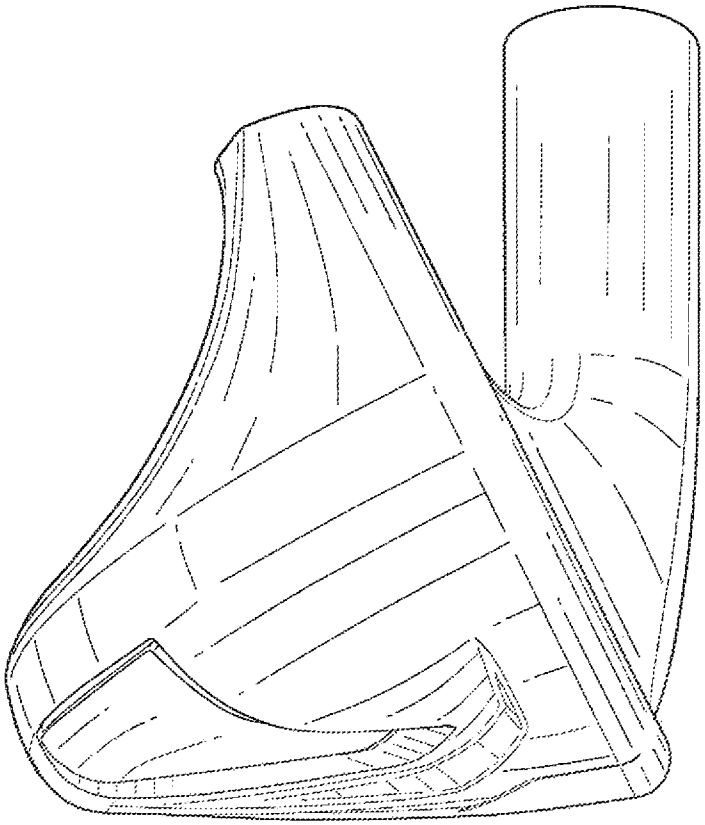
FIG. 18 shows a toe side elevation view of the golf club head of FIG. 14.
Figure 19:
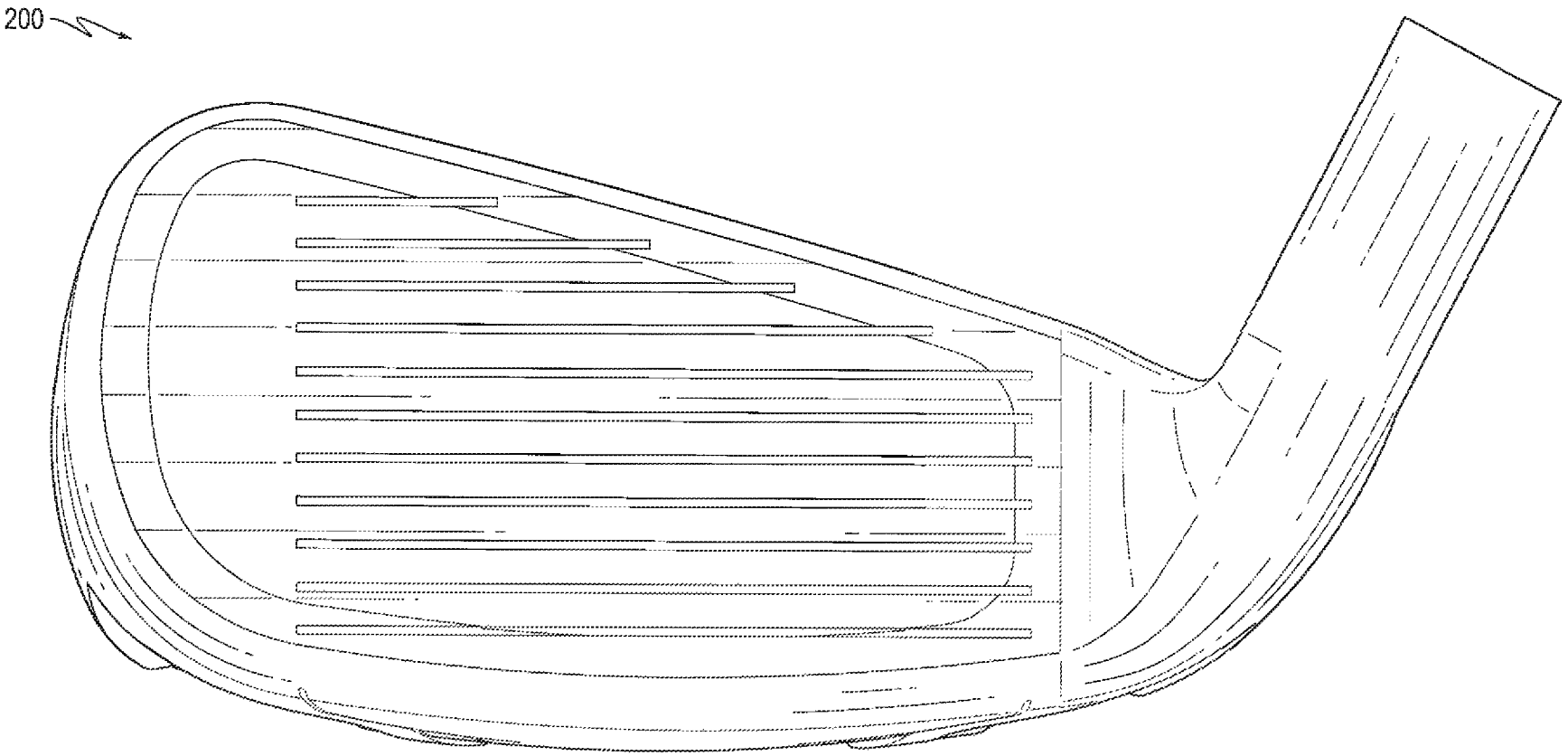
FIG. 19 shows a front elevation view of the golf club head of FIG. 14.
Figure 20:
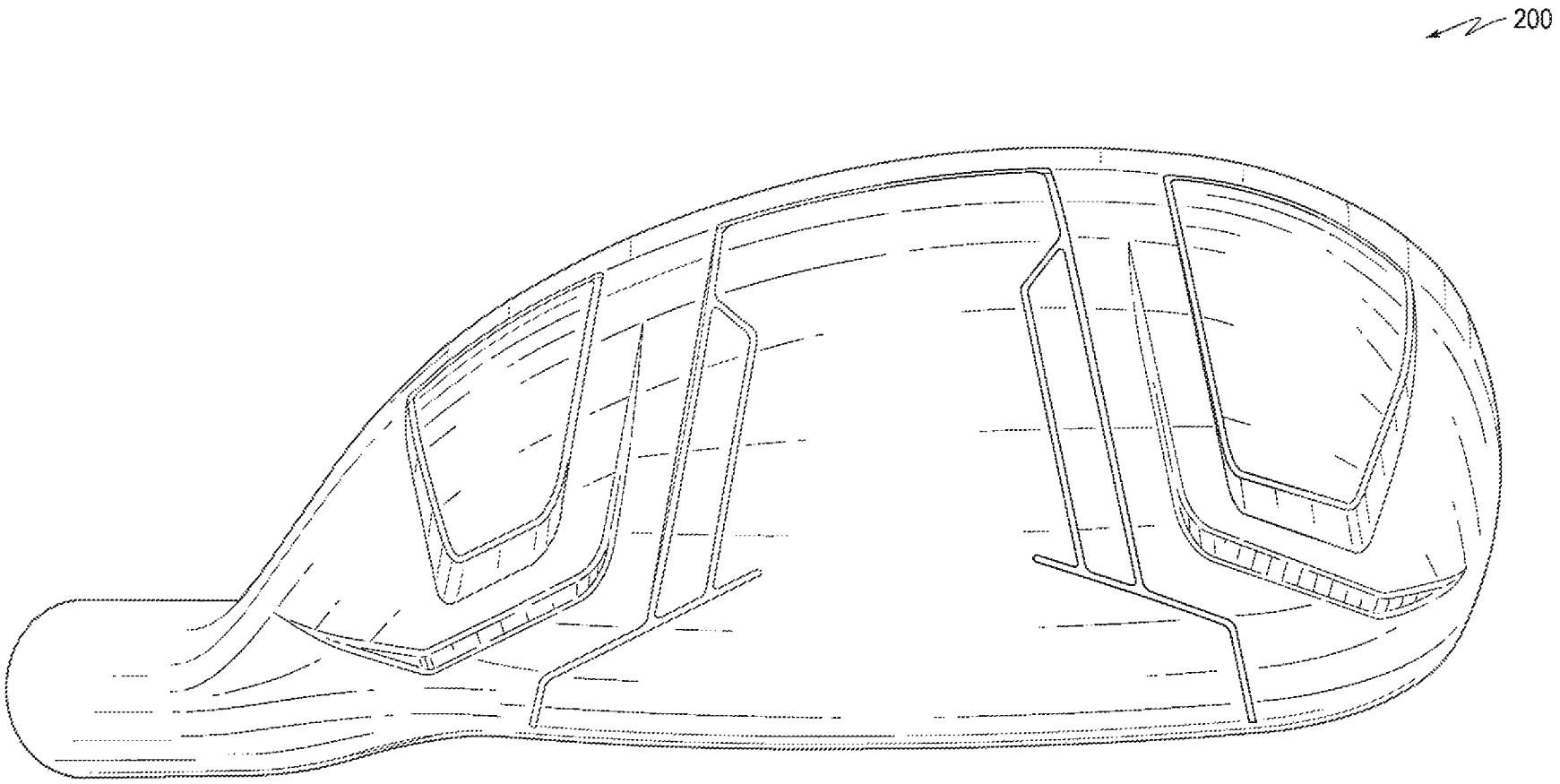
FIG. 20 shows a bottom view of the golf club head of FIG. 14.
Figure 21:
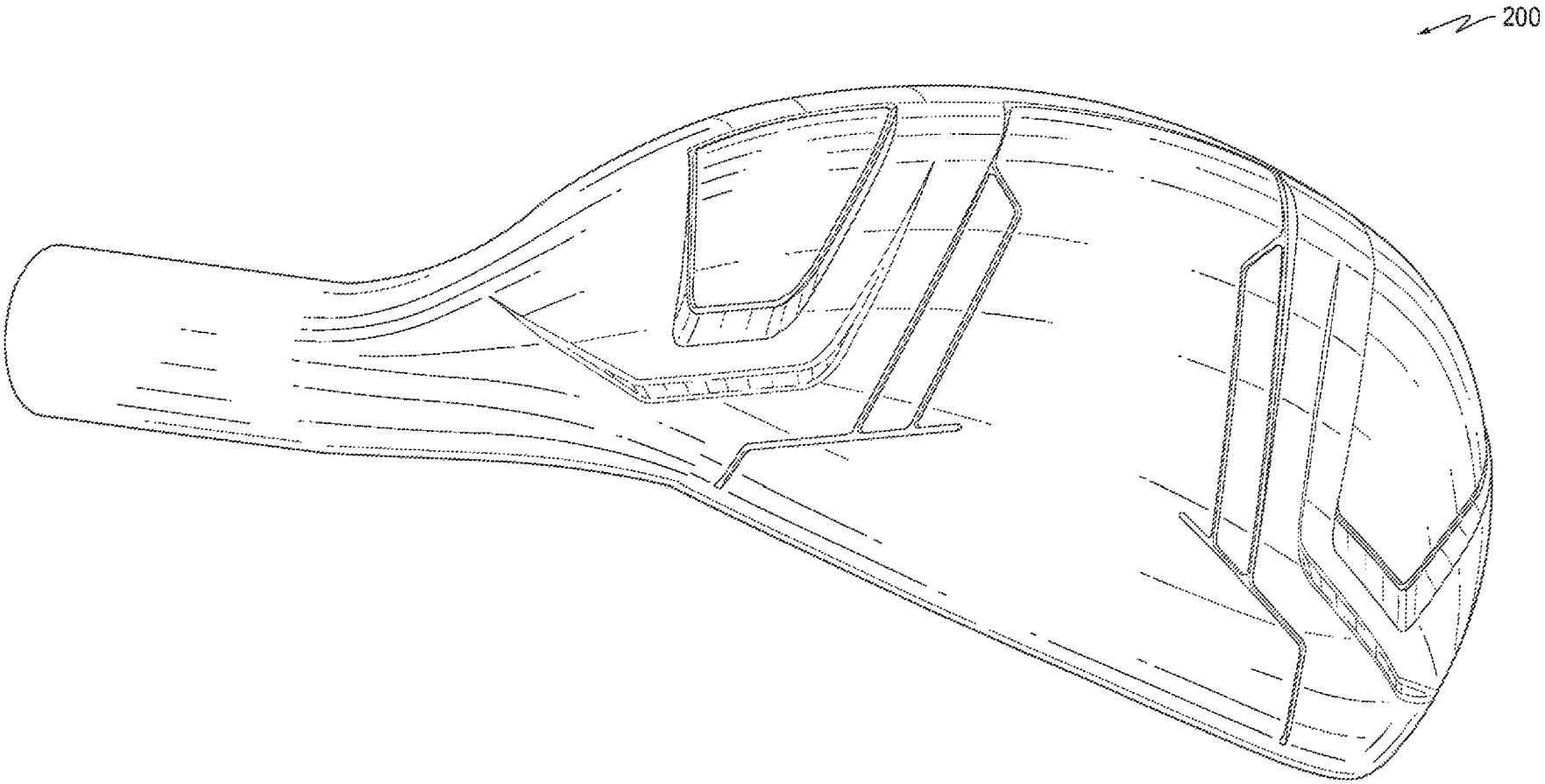
FIG. 21 shows a bottom perspective view of the golf club head of FIG. 14.
Figure 22:
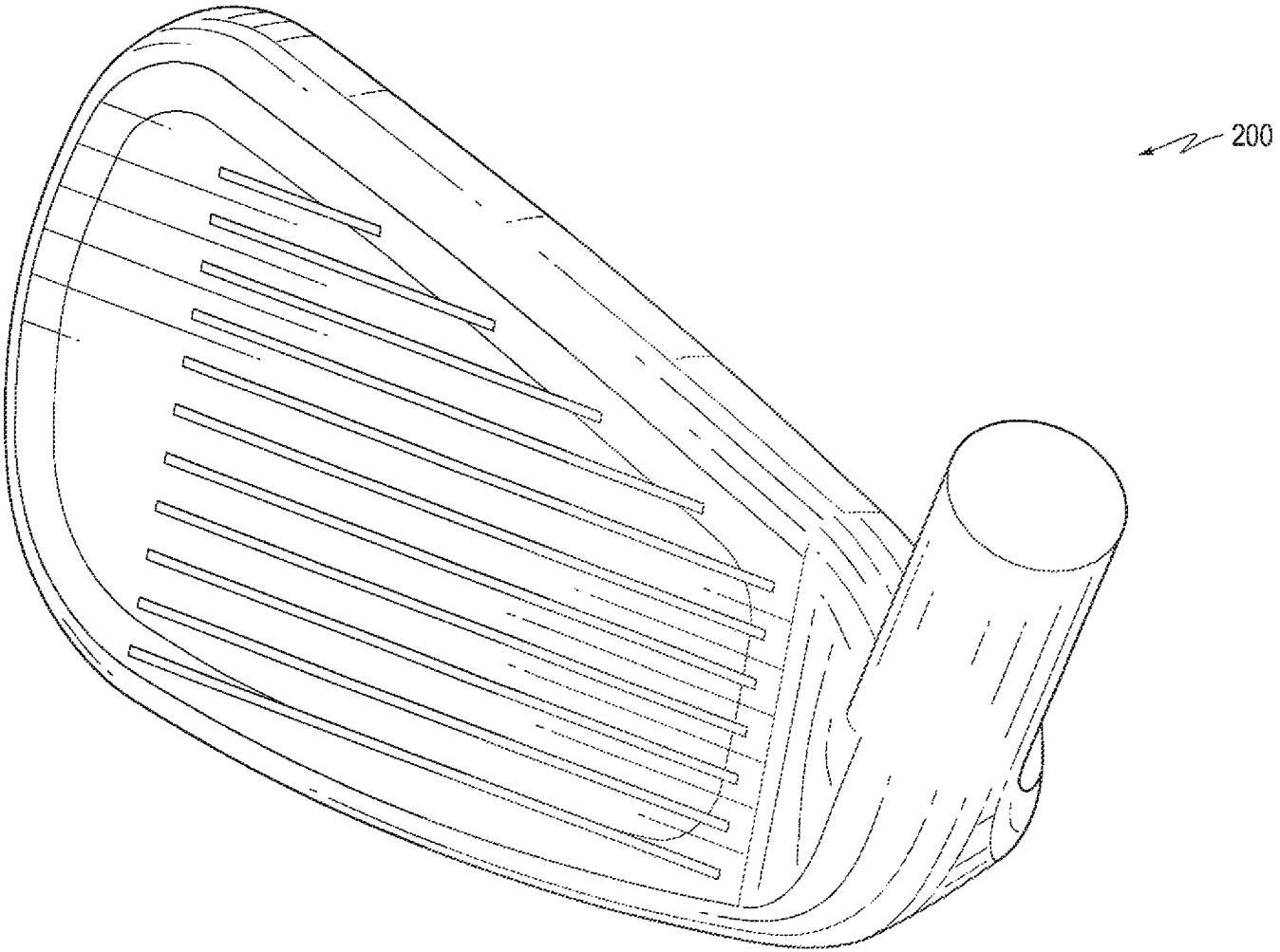
FIG. 22 shows a front perspective view of the golf club head of FIG. 14.

The golf club head 200 shown in FIG. 14 includes a hosel 250, a top portion 230, a rear portion 270, a sole portion 240, a heel 210, a toe 220, and a striking face 260. The striking face 260 may include scorelines 262 and a face center 268 similar to that described in connection with the set of FIG. 1. Despite being a set composed mostly or entirely of hollow-type golf club heads, one, two, three, or all club heads of such set may include a striking wall having thickness and material characteristics described above with regard to the golf club head set embodiment shown in FIG. 1. Furthermore, two, three, or all golf club heads of the set shown in FIGS. 14-22 may include CG location attributes (e.g. Dcg), MOI characteristics (e.g. Izz) in correlation with their lofts in similar manner as described in association with the set shown in FIG. 1. Further still, one, two, or all club heads of the set shown in FIGS. 14-22 may include a full or substantially entirely enclosed hollow cavity that contains therewithin stiffening elements (e.g.) ribs for tuning sound and vibratory properties of the club head in any of the manners variously described with regard to the set embodiment of FIG. 1.

Referring particularly to FIG. 14, the top portion 230 of the golf club head 200 may include both a top line portion 232 of a substantially constant width in the heel to toe direction as well as a rear portion 270, which is recessed relative to surrounding peripheral portions of the main body of the club head. The recessed region 272 may form a generally bowl-shaped region or concavity as understood at least in the front to rear direction as well as, in some embodiments, in the heel-to-toe direction. External stiffening features 274, e.g. stiffening elements or ribs, may be placed within such recessed rear region for further stabilizing and/or stiffening this region of the club head. Such features may enable the use of a thinner wall thickness of the top portion 230, thereby both increasing overall discretionary mass for any of the reasons described above as well as for, in and of itself, shifting the CG lower.

While various features have been described in conjunction with the examples outlined above, various alternatives, modifications, variations, and/or improvements of those features and/or examples may be possible. Accordingly, the examples, as set forth above, are intended to be only illustrative. Various changes may be made without departing from the broad spirit and scope of the underlying principles.

What is claimed is:

1. A set of golf club heads comprising:

at least one hollow-type golf club head and at least one cavity-back golf club head;

wherein at least two differently-lofted golf club heads of the set, when oriented in a reference position, each comprise a striking face, a loft, L, a center of gravity spaced from the striking by a depth, Dcg, and a moment of inertia, Izz, about a virtual vertical axis passing through the center of gravity such that the following is satisfied:

$$2.2017*L^2-63.276*L+3500 \leq Izz/Dcg \leq 2.2017*L^2-63.276*L+4200$$

wherein L is measured in degrees, Izz is measured in g*cm$^2$, and Dcg is measured in cm.

2. The set of golf club heads of claim 1, wherein at least three differently-lofted golf club heads of the set, when oriented in a reference position, each comprise a striking face, a loft, L, a center of gravity spaced from the striking by a depth, Dcg, and a moment of inertia, Izz, about a virtual vertical axis passing through the center of gravity such that the following is satisfied:

$$2.2017*L^2-63.276*L+3500 \leq Izz/Dcg \leq 2.2017*L^2-63.276*L+4200$$

wherein L is measured in degrees, Izz is measured in g*cm$^2$, and Dcg is measured in cm.

3. The set of golf club heads of claim 1, wherein the at least two differently-lofted golf club heads comprise:

a first golf club head comprising a hollow-type golf club head and a first loft between 18° and 28°; and a second golf club head comprising a cavity-back golf club head and a second loft between 34° and 50°.

4. The set of golf club heads of claim 1, wherein:

the moment of inertia, Izz, of each of the at least two differently-lofted golf club heads of the set is no less than 2500 g*cm$^2$.

5. The set of golf club heads of claim 1, wherein the at least two differently-lofted golf club heads of the set each comprise a head mass no greater than about 300 g.

6. The set of golf club heads of claim 1, wherein at least one of the at least two differently-lofted golf club heads of the set comprises a top portion, a sole portion, a striking wall, and a rear portion that form a substantially enclosed interior cavity, the interior cavity including at least one stiffening element secured to at least one of the sole portion and the top portion.

* * * * *